United States Patent [19]

Landin

[11] Patent Number: 4,757,998

[45] Date of Patent: Jul. 19, 1988

[54] SAFETY DEVICE FOR A WEIGHT-TRAINING BENCH

[76] Inventor: Michael G. Landin, 1525 5th St. NE., Apt. B, East Wenatchee, Wash. 98801

[21] Appl. No.: 52,499

[22] Filed: May 21, 1987

[51] Int. Cl.[4] ..... A63B 13/00

[52] U.S. Cl. ..... 272/123

[58] Field of Search ..... 272/63, 117, 123, 134, 272/144, DIG. 4; 248/240, 240.2, 245, 249

[56] References Cited

U.S. PATENT DOCUMENTS

| | | | |
|---|---|---|---|
| 1,054,228 | 2/1913 | Medlin | 248/240 |
| 3,368,784 | 2/1968 | Peterson | 248/245 |
| 3,891,207 | 6/1975 | Helliwell | 272/144 |
| 4,231,570 | 11/1980 | Reis | 272/123 |
| 4,249,726 | 2/1981 | Faust | 272/123 |
| 4,302,009 | 11/1981 | Johnson | 272/123 |
| 4,368,884 | 1/1983 | Colvin | 272/123 |
| 4,602,785 | 7/1986 | Rockwell | 272/123 |
| 4,615,524 | 10/1986 | Sutherland | 272/123 |
| 4,635,930 | 1/1987 | Cormier | 272/123 |
| 4,648,595 | 3/1987 | Selle | 272/123 |
| 4,650,186 | 3/1987 | McCreery et al. | 272/123 X |
| 4,662,631 | 5/1987 | Seal | 272/123 |

FOREIGN PATENT DOCUMENTS

| | | | |
|---|---|---|---|
| 3423837 | 1/1986 | Fed. Rep. of Germany | 272/134 |
| 2561528 | 9/1985 | France | 272/134 |

*Primary Examiner*—Richard J. Apley
*Assistant Examiner*—Robert D. Bahr
*Attorney, Agent, or Firm*—Mark Zovko

[57] ABSTRACT

A safety device for use in bench pressing includes at least one bar overlying a bench in a generally longitudinal direction. The bar, or preferably pair of bars, is located near the center line of the bench and is preferably pivotally moveable downward to an operable position in which it overlies the bench. Hooks for retaining a weight upon supporting uprights while the device is pivoted up from its operable position and locks for locking the device in the weight-retaining position may also be provided.

6 Claims, 2 Drawing Sheets

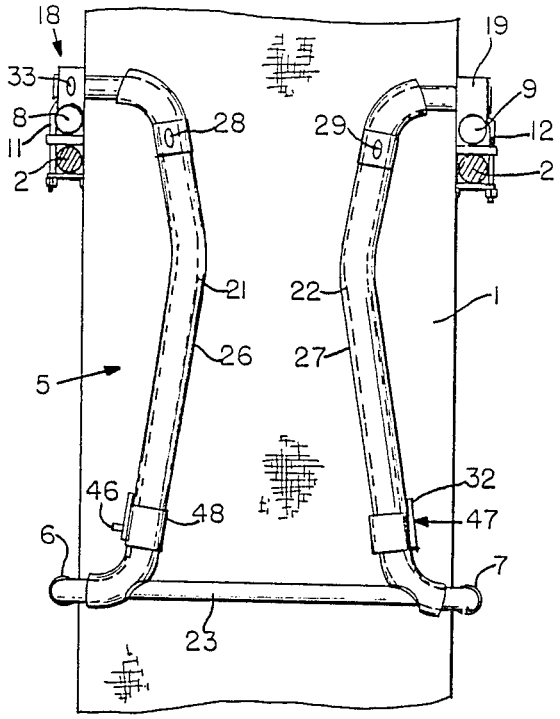
FIG. 3
FIG. 4
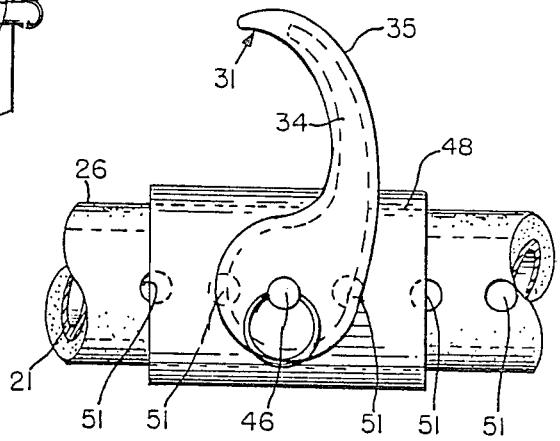
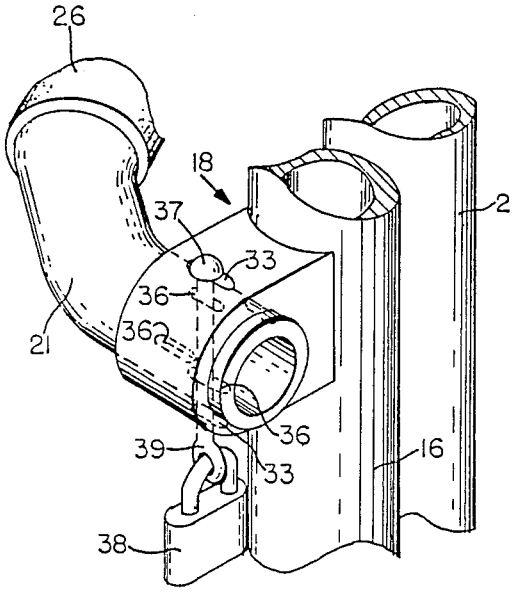
FIG. 5

SAFETY DEVICE FOR A WEIGHT-TRAINING BENCH

BACKGROUND OF THE INVENTION

1. Field of the Invention

This invention relates to exercise equipment and, more specifically, to weight-training apparatus.

2. Description of the Prior Art

Weight training with barbells and dumbbells is rapidly gaining popularity because leisure time and awareness of the importance of exercise is increasing, and because sports like powerlifting and body building are receiving an increasing amount of publicity in television and popular media. One of the most basic weight training exercises is the bench press, in which the trainee lies on his back on a flat, horizontal bench and lifts a barbell from a position adjacent his chest to one in which it is held at arm's length above him. A considerable amount of weight can be lifted in this exercise, and it is common for a person who has trained at this exercise for a few months to be capable of bench-pressing a poundage equal to his body weight. Many persons can bench press over 200 pounds and, while it is not common, bench presses of over 400 pounds are being performed in many gyms and weight rooms.

Often an enthusiastic trainee will bench press to the point of exhaustion and total muscular failure, or will attempt to bench press an amount of weight at the very limit of, or even beyond, his present abilities. In such a case, the danger of the trainee dropping the weighted barbell upon his upper torso is evident. This can cause a crushing injury or, if the barbell lands on the trainee's neck, can cause strangulation or obstruction of blood flow to the brain. A less evident but highly significant danger of the bench press results from the common tendency of a trainee to hold his breath while lifting a heavy weight. This causes what is known as a Valsalva Effect, in which increased intrathoracic pressure hinders blood flow between the brain and heart, causing the trainee to black out. In such a case, even if the trainee had proceeded cautiously, taking care not to become totally fatigued or to attempt a lift beyond his capability, he would, of course, drop the barbell upon himself on becoming unconscious. And, since he would be unconscious, he would be unable to call out for help.

To bench press safely, many trainees have a partner stand at the head of the bench ready to assist if the trainee can no longer support the barbell. However, many persons train alone by choice or necessity, and training alone may become more common as more people invest in home gym equipment such as weight benches and weight sets, rather than paying to train in a public gym. While such a trainee may be able to cry for help to a family member in another room if he is conscious and able to perceive that he can no longer support the barbell, if he blacks out due to the Valsalva Effect this option is no longer his. Even in public gymnasiums, trainees have died or become seriously injured when they became trapped with a barbell resting on their necks, cutting off blood flow to the brain or suffocating them. These types of injuries occur when a trainee has lost consciousness in one area of the gym and thus is unable to attract the attention of persons in other areas of the gym by crying out for assistance or gesturing.

The increasing number of weight trainees who practice the bench press need a protective device to guard them against injuries. Obviously, a passive device is needed because of the possibility of becoming unconscious. However, the natural tendencies to panic upon sensing danger and to become light-headed during extreme physical exertion also necessitate a passive safety device. To ensure that such a device would in fact be used by a trainee, it must not interfere with his movement or comfort while he performs his exercise. Ideally, a safety device would make it impossible for the trainee to use his equipment unless the safety device was presently operable. And, it would be highly advantageous for a device to prevent use of equipment by unauthorized or unsupervised persons. For example, persons who have weight sets at home and also have small children need a means to prevent the children from injuring themselves by attempting to imitate the trainee during unsupervised play. It is also desirable for the gym owner or coach concerned with the unauthorized use of weight training equipment to have at his disposal means for preventing its use.

Prior art devices have not successfully protected a trainee during the bench press in a passive manner, and in a manner which will not interfere with his movement while performing the exercise. For example, U.S. Pat. No. 4,231,570 to Reis discloses a device which interferes with a trainee's freedom of movement, in that the trainee will be unable to complete a full downward movement of the barbell without the device obstructing the movement before it is completed. The device also obstructs inward movement of the arms and shoulder joint. Safety devices disclosed in U.S. Pat. Nos. 4,249,726 to Faust and 4,256,301 to Goyette depend upon a trainee being fully conscious and coherent, and able to operate a foot-controlled device. Obviously, these devices are useless for an unconscious trainee, or one who, due to fatigue, panic, or lack of knowledge, is not in the clear state of mind necessary to operate a foot control on a safety device.

The prior art devices in these patents are less than optimal since the bench upon which they are installed can be used without the devices being operable. Thus, they allow a trainee to ignore the safety device and simply not use it. Furthermore, prior art devices do not include means for preventing undesired use of the equipment by unauthorized or unsupervised persons.

SUMMARY OF THE INVENTION

The safety device of the present invention includes at least one bar overlying a bench in a generally longitudinal direction. The bar, or preferably pair of bars, is spaced from the sides of the bench and is preferably pivotally moveable downward to an operable position in which it overlies the bench. Means for retaining a weight upon supporting uprights while the device is pivoted up from its operable position and means for locking the device in the weight-retaining position may also be provided.

The present invention provides a passive device which will function without any action by the trainee. The device will prevent a barbell from dropping upon a trainee's neck and from crushing his torso without the trainee's needing to be in a fully present state of mind, or even needing to be conscious, to take advantage of the safety device.

Because that part of the invention in proximity to the trainee's chest and shoulders is near the center line of the bench, the safety device of the present invention allows the trainee a full range of movement. His arms are free to move inward toward the center line of his body, and his shoulders and pectorals can move upward and inward, as in the final stage of a bench press, with no obstruction. Also, the device can be adjusted to allow full downward movement of a barbell to prevent the downward portion of the bench pressing movement from being cut short. The device can also be made adjustable upward for the trainee who wishes to perform what is known as power rack training, in which only a portion of movement, such as the last few upward inches, is performed.

The device can be manufactured as an accessory for those who already own weight benches, since it is easily adapted for installation on any commerically available exercise bench, making it desirable to home weight equipment owners. Alternatively the device can be made unitary with a bench. In either case, the safety device can be constructed to withstand heavy use, to support at least 1,000 pounds of static weight, and to withstand the impact of at least 500 pounds dropped from arm's length overhead.

Once installed, the device, in one embodiment, will restrain a barbell from being lifted from the supports on the bench unless the device is resting over the trainee's body, and can be locked in the barbell-restraining position.

Other advantages of the device will be evident from the drawings and the detailed description thereof.

BRIEF DESCRIPTION OF THE DRAWINGS

FIG. 3 is a top plan view of the FIG. 1 embodiment.

FIG. 4 is an elevational detail of the bar latching mechanism.

FIG. 5 is a perspective view of a locking mechanism in the FIG. 1 embodiment.

DETAILED DESCRIPTION OF THE DRAWINGS

Figure 1:
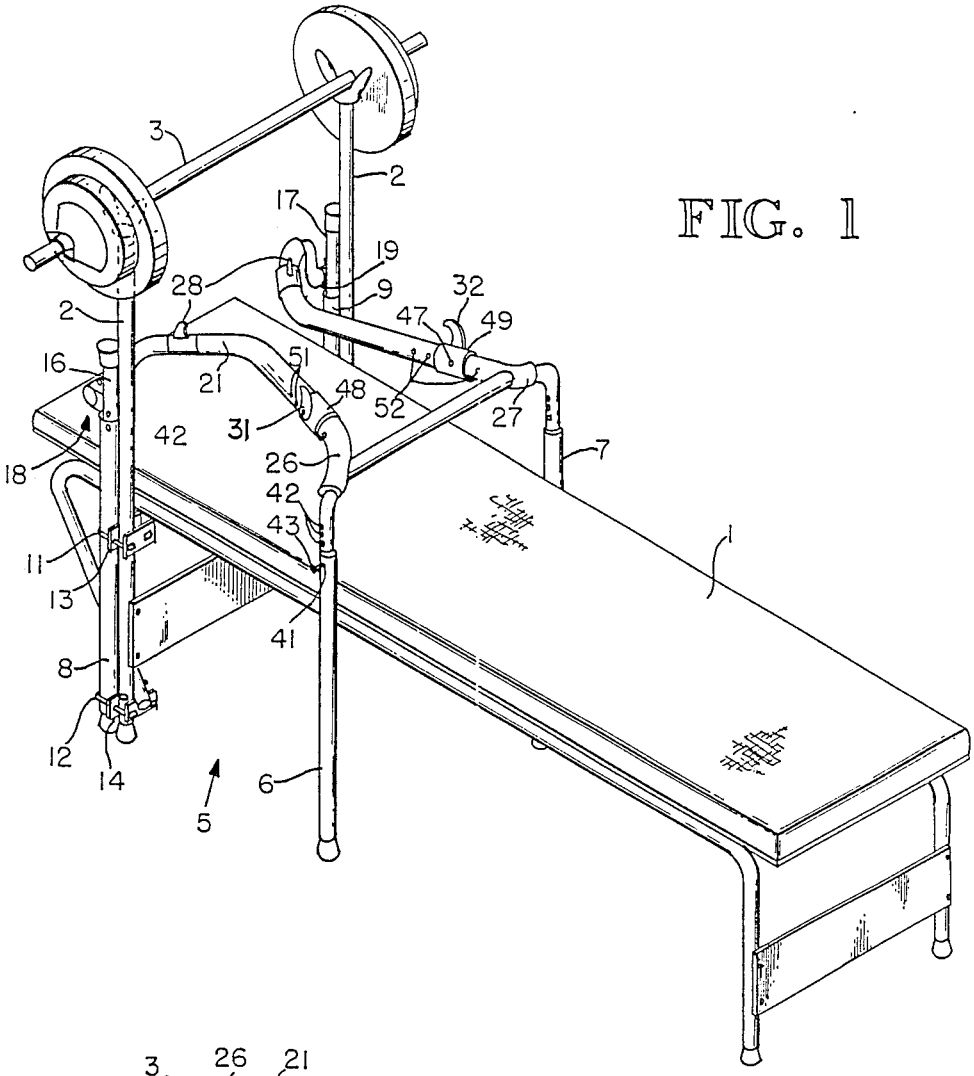
FIG. 1 is a perspective view of one embodiment of the invention mounted on a bench with a barbell in place.
Figure 2:
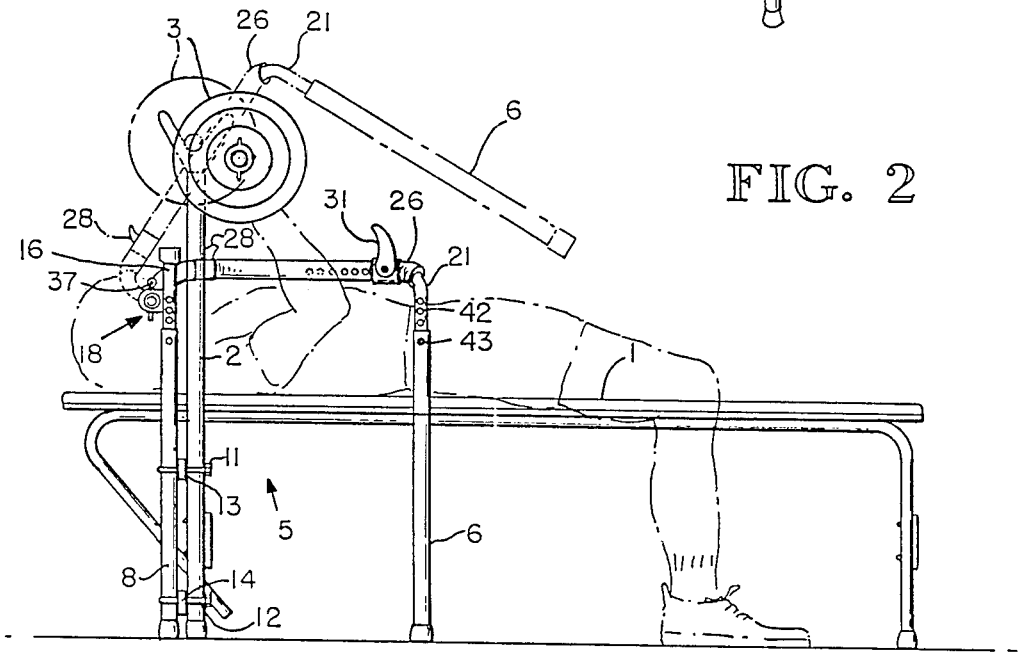
FIG. 2 is a side elevational view of the FIG. 1 embodiment showing its manner of use by a trainee.

Referring to FIGS. 1 and 2, equipment for performing a bench press commonly includes a flat, horizontal bench 1 having at one end a pair of upright supports 2 upon which a barbell 3 rests. In performing a bench press, the trainee lies on his back on the bench 1 as shown in FIG. 2, and either lifts the barbell 3 off the supports 2 or has it handed to him. He lowers the barbell 3 to his chest, and then raises it up to a position where his arms are locked out above him.

Referring to FIGS. 1, 2 and 3, the safety device 5 of the present invention in the illustrated embodiment has four supporting legs 6, 7, 8, 9, two of which, 8 and 9, are mounted to the supports 2 of bench 1 by any common means such as U-bolts 11 and 12, with spacers 13 and 14 resting between each leg 8 and 9 and the upright 2. In this manner, the safety device can be easily installed by hand on any bench, although if a built-in safety device is desired, the legs 8 and 9 can be unitarily formed with the supports 2. Telescopingly engaged with the legs 8 and 9 are tubes 16 and 17, respectively, on which horizontal pivot brackets 18 and 19, respectively, are mounted. Protective bars 21 and 22 are pivotally mounted by any commonly known means in the pivot brackets 18 and 19, respectively, and each bar when pivoted to a position parallel to the bench 1 extends transverse to the length of the bench for a short distance, then curves toward the center line of the bench 1.

The distance between protective bars 21 and 22 at their closest point is preferably about six inches. This six-inch distance is narrow enough to allow a full range of shoulder, chest and arm movement if the trainee positions himself with the line of his shoulders under this narrow portion, while being wide enough to support and balance a barbell resting thereon. It will be understood, of course, that alternative configurations, such as the joining of bars 21 and 22 into a single, unitary bar at their closest point, are within the scope of the invention.

From their narrowest point, the two protective bars 21 and 22 curve outward and vertically downward to be telescopingly engaged with the legs 6 and 7, respectively, which are preferably about two feet from the supports 2, so that the legs 6 and 7 will be in proximity to the hip area of a trainee of average height who has his shoulders properly positioned under the narrowest portion of the device 5. A crossbar 23 joins the protective bars 21 and 22 near their juncture with the legs 6 and 7 to add structural support to the device. The provision of crossbar 23 also has the advantage of restraining the trainee from cheating during his performance of the bench press by restricting the raising of the hip area from the bench. The crossbar 23 can be padded with a foam sleeve for comfort, and the legs 6 and 7 have between them an ample distance of, for example, 18 inches, to accommodate the hip area.

The protective bars 21 and 22 are preferably covered with half-inch thick closed cell foam sleeves 26 and 27 to absorb shock when a barbell is dropped upon the bars 21 and 22 and to minimize damage to the barbell 3 and protective device 5. The foam sleeves 26 and 27 also decrease noise, both from the dropping of a barbell 3, and also from the controlled lowering of the barbell 3 to a position where it contacts the bars 21 and 22. A pair of hooks 28 and 29 mounted on the protective bars 21 and 22 near the head of the bench 1 are positioned to prevent a barbell 3 dropped upon the device from rolling over a trainee's face and off the protective bars 21 and 22. A second pair of hooks 31 and 32 are mounted to the protective bars 21 and 22 near the crossbar 23 to prevent a dropped barbell 3 from rolling off the device 5 onto the lower torso of the trainee. The foam sleeves 26 and 27 also act to prevent rolling of a barbell 3. These roll-restraining means make the device 5 fail-safe, since a trainee need not be concerned with unevenness in the surface on which the device rests, or vibration or impact from outside sources, causing a dropped barbell 3 to roll off the protective bars 21 and 22 onto his head or lower body if he is not conscious.

The hooks 31 and 32 serve another important function. As is most easily seen in FIG. 2, the safety device 5, when in a position in which it is operable as a protective shield, has its legs 6 and 7 resting on the floor with the protective bars 21 and 22 lying over the torso of the trainee. However, the protective bars 21 and 22 can be pivoted upward to the position shown in phantom in FIG. 2, in which the hooks 31 and 32, which have sufficient resiliency to snap over the barbell 3 resting on supports 2, latch the barbell thereon. The barbell 3 cannot be lifted from the supports 2 when the safety device 5 is in this position. Only after the safety device 5 is pulled off the barbell 3, causing the device 5 to pivot downward over the bench 1, can the barbell 3 be moved from the supports 2. Referring to FIG. 4, each of the barbell-latching hooks 31 and 32 includes a metal core 34 injected into a plastic hook 35, resulting in a strong and durable mechanism with sufficient elasticity to snap onto and off of a barbell and sufficient strength to restrain a rolling barbell.

Because of this latching mechanism, a bench press cannot be performed unless the safety device 5 is in an operable position. Furthermore, the latching of the barbell 3 onto the supports 2 by the hooks 31 and 32 allows weight discs to be removed from or added to the ends of the barbell 3 without the danger of the barbell 3 becoming unbalanced and flipping up from the supports 2, causing injury to persons or damage to to the equipment or surroundings.

In addition to these advantages of this novel feature of the invention, the device 5 can be adapted to be locked in the barbell latching position, preventing unauthorized use of the bench 1 and barbell 3. The locking mechanism is shown most clearly in FIG. 5. The pivot bracket 18 mounted on tube 16 has a pair of vertically opposed slots 33 therethrough. Likewise, the end of protective bar 21 has a plurality of pairs of radially opposed slots 36 extending therethrough. When the safety device 5 is pivoted up to a position where resilient hooks 31 and 32 retain the barbell 3 in the supports 2, a pin 37 having an eye 39 on one end can be passed through the slots 33 and 36 in the protective bar 21 and pivot bracket 18, with a minor adjustment in the position of protective bar 21 being made if necessary. With any commonly available padlock 38 secured through the eye 39 in pin 37, the pin 37 cannot be removed from the slots 33 and 36, and pivotal movement of the protective bar 21 within the pivot bracket 18 is blocked. The device 5 cannot be pivoted down from the barbell retaining position until the padlock 38 is removed. It will be understood, of course, that locking means can be placed on either side of the device 5, and that alternative locking means are within the scope of the invention.

The safety device 5 in the illustrated embodiment is fully adjustable to fit any bench and the requirements of any trainee. To this end, leg 6 has a pair of holes 41 on opposite sides thereof, and protective bar 21 has a plurality of holes 42 which will come into alignment with the holes 41 in the leg 6 when the bar 21 is telescopingly moved therein. A pin 43 inserted through the holes in the leg 6 and bar 21 will secure them in the desired relative position. Identical adjustment means are provided on leg 7 and protective bar 22, and below the pivot brackets 18 and 19 on the tubes 16 and 17 engaged in legs 7 and 8.

The positions of the barbell-latching hooks 31 and 32 along the protective bars 21 and 22 are similarly adjusted by means of pins 46 and 47 passing through sleeves 48 and 49 upon which the hooks 31 and 32 respectively are rigidly mounted. The protective bars 21 and 22, which have a plurality of holes 51 and 52, extend through the sleeves 48 and 49 respectively. The positions of the hooks 31 and 32 are adjusted so that the hooks will fit over a barbell 3 resting on the supports 2 when the device 5 is pivoted up to its nonoperable position. The hooks 31 and 32 are then fastened in place by the pins 46 and 47 which may include any well known means such as a spring-loaded detent to hold them securely in place. Such fastening means, together with the above-described locking means, will be sufficient to protect small children, and to dissuade others from unauthorized use of the equipment. If greater security is desired, once the initial adjustment is made the hooks 31 and 32 can be permanently attached to the bars 21 and 22 by any commonly known means such as riveting to prevent tampering.

The protective bars 21 and 22 and crossbar 23 are preferably constructed of one-inch steel tubing. Legs 6, 7, 8 and 9 are preferably one and ¼ inch steel tubing. This choice of materials gives the device enough strength to withstand the impact of a 500 pound barbell dropped from arm's length over the device. While this will be more than adequate for the requirements of all but a few top powerlifters, it will be understood, of course, that modifications of materials or design details can be made to adapt the device 5 for specific applications. For example, a welded construction and square tubing may be desired for heavy-duty use in public weight rooms, while lighter materials and bolted construction may be desired for casual home use.

In typical operation, a trainee desiring to bench press adjusts the weight on barbell 3 while the device 5 is pivoted up onto the barbell 3, and then unlocks the padlock 38 and removes pin 37 if the locking mechanism is engaged. The trainee lies on the bench and pulls the protective bars 21 and 22 over his body, snapping the hooks 31 and 32 off the barbell 3. If necessary, the height of protective bars 21 and 22 over his body is adjusted by the pin and hole arrangements in the telescoping legs 6 and 7 and bars 21 and 22, and legs 8 and 9 and tubes 16 and 17. The trainee will usually want the protective bars 21 and 22 to be touching, or about ½ inch above, his chest to afford him the greatest range of downward movement. The trainee then lifts the barbell 3 off the supports 2 and performs the bench press exercise. If he should drop the barbell, or be unable to raise it back up to the supports 2, the barbell 3 will rest upon the protective bars 21 and 22, and the trainee will be completely safe and uninjured.

Upon completing his exercise, the trainee replaces the barbell 3 upon the supports 2, lifts the device 5 up from his body and snaps the hooks 31 and 32 over the barbell 3. The trainee can then get up from the bench and, if desired, secure the device with pin 37 and padlock 38.

While the invention has been described above with reference to a particular embodiment and to a particular usage, it will be understood that the above description is illustrative and not intended to be limiting, and that the device as used for activities other than weight training and the bench press are within the scope of the invention.

What is claimed is:

1. Weight training safety apparatus comprising:

a. a weight lifting bench having a horizontal support surface of predetermined width and length with forward and rearward ends for supporting a weight lifter thereon in a generally supine position along its longitudinal length and upright weight supports for supporting weights placed thereon located adjacent to the forward end of the horizontal support surface;

b. a pair of protective bars aligned in a first position extending horizontally and in a longitudinal direction over the horizontal support surface of said weight lifting bench from a location adjacent the upright weight supports toward the rearward end of the horizontal support surface;

c. holding means for holding said protective bars in said first position, said holding means operatively associated with said weight lifting bench;

d. pivoting means connected to said protective bars adjacent to the upright supports of said weight lifting bench for pivotally mounting said protective bars relative to the upright supports of said weight lifting bench whereby said protective bars can be moved from said first horizontal position to a second position in which said protective bars extend upward relative to the horizontal surface of said weight lifting bench; and e. first weight retaining means connected to said protective bars adjacent the rearward end of the horizontal support surface of said weight lifting bench when said protective bars are in said first position, said first weight retaining means for retaining weights placed on the upright supports of the weight lifting bench when said protective bars are pivoted to said second position.

2. The apparatus of claim 1 wherein said first weight retaining means is a hook member with the tip of the hook member directed toward the frontward end of the horizontal support surface of said weight lifting bench when said protective bars are in said first position.

3. The apparatus of claim 2 wherein said hook member is selectively adjustable.

4. The apparatus of claim 1 which includes second weight retaining means connected to said protective bars adjacent the frontward end of the horizontal support surface of said weight lifting bench when said protective bars are in said first position; said second weight retaining means for retaining weights dropped on said protective bars.

5. The apparatus of claim 4 wherein said second weight retaining means is a hook member with its tip directed toward the rearward end of the horizontal support surface of said weight lifting bench when said protective bars are in said first position.

6. The apparatus of claim 1 wherein said protective bars are curved toward the longitudinal center line of the horizontal support surface of the weight bench adjacent to the upright supports.

* * * * *